US008003922B2

(12) United States Patent
Seger

(10) Patent No.: US 8,003,922 B2
(45) Date of Patent: Aug. 23, 2011

(54) SOLID STATE SWITCH WITH OVER-TEMPERATURE AND OVER-CURRENT PROTECTION

(75) Inventor: Ronald Neil Seger, Prior Lake, MN (US)

(73) Assignee: Phillips & Temro Industries Inc., Eden Prairie, MN (US)

( * ) Notice: Subject to any disclaimer, the term of this patent is extended or adjusted under 35 U.S.C. 154(b) by 1292 days.

(21) Appl. No.: 11/636,692

(22) Filed: Dec. 8, 2006

(65) Prior Publication Data

US 2007/0194009 A1 Aug. 23, 2007

Related U.S. Application Data

(63) Continuation-in-part of application No. 11/486,884, filed on Jul. 14, 2006.

(60) Provisional application No. 60/774,893, filed on Feb. 17, 2006.

(51) Int. Cl.
*H05B 1/02* (2006.01)

(52) U.S. Cl. ..... 219/502; 219/497; 219/202; 219/205; 219/519; 123/556

(58) Field of Classification Search ..... 219/497, 219/505, 502, 501, 202–206, 481, 492; 123/145 A, 123/556

See application file for complete search history.

(56) References Cited

U.S. PATENT DOCUMENTS

| | | | | |
|---|---|---|---|---|
| 3,851,278 | A | 11/1974 | Isono | |
| 3,934,567 | A | 1/1976 | Fujieda et al. | |
| 4,034,204 | A | 7/1977 | Windsor et al. | |
| 4,944,260 | A | 7/1990 | Shea et al. | |
| 5,094,198 | A | 3/1992 | Trotta et al. | |
| 5,347,966 | A | 9/1994 | Mahon et al. | |
| 5,922,232 | A | 7/1999 | Merz | |
| 5,990,459 | A | 11/1999 | Feustel et al. | |
| 6,084,218 | A * | 7/2000 | McDonough | 219/508 |
| 6,392,207 | B2 | 5/2002 | Beetz et al. | |
| 6,477,047 | B1 * | 11/2002 | Markwardt et al. | 361/704 |
| 6,635,851 | B2 | 10/2003 | Uhl | |
| 6,700,105 | B2 | 3/2004 | Morrison | |
| 6,712,032 | B2 | 3/2004 | Uhl | |
| 6,715,472 | B2 | 4/2004 | Stephan et al. | |

(Continued)

FOREIGN PATENT DOCUMENTS

WO WO2005/012807 2/2005

OTHER PUBLICATIONS

"Thermal Substrates: T-Clad," The Bergquist Company, http://www.bergquistcompany.com/ts_thermal_clad.cfm, Copyright 2006.

(Continued)

*Primary Examiner* — Mark H Paschall

(74) *Attorney, Agent, or Firm* — Harness, Dickey & Pierce, P.L.C.

(57) ABSTRACT

An intake air heating system for an internal combustion engine includes an electric heater that heats the intake air, a control circuit that switches a voltage to the electric heater based on a control signal and an over-temperature signal, a temperature sensor that generates a temperature signal based on a temperature of the control circuit, and a temperature sensing circuit that generates the over-temperature signal based on the temperature signal and a predetermined temperature.

33 Claims, 9 Drawing Sheets

U.S. PATENT DOCUMENTS

| | | | | |
|---|---|---|---|---|
| 6,736,098 | B2 | 5/2004 | Toedter et al. | |
| 6,807,041 | B2 | 10/2004 | Geiger et al. | |
| 6,810,203 | B2 | 10/2004 | Alban et al. | |
| 6,872,922 | B2 | 3/2005 | Uhl | |
| 6,906,288 | B2 | 6/2005 | Toedter et al. | |
| 6,911,630 | B2 | 6/2005 | Neckel | |
| 6,964,269 | B2 | 11/2005 | Gschwind et al. | |
| 7,002,106 | B2 | 2/2006 | Toedter et al. | |
| 7,044,115 | B2 | 5/2006 | Gschwind et al. | |
| 7,190,893 | B2 * | 3/2007 | Kuebler et al. | 392/485 |
| 2002/0000221 | A1 * | 1/2002 | Kilb et al. | 123/556 |
| 2002/0092508 | A1 | 7/2002 | Kanekawa et al. | |
| 2004/0003800 | A1 | 1/2004 | Gschwind et al. | |
| 2004/0025852 | A1 | 2/2004 | Kanekawa et al. | |
| 2004/0126286 | A1 | 7/2004 | deRuyter | |
| 2005/0034449 | A1 | 2/2005 | Frieden et al. | |
| 2005/0092727 | A1 | 5/2005 | Fraley et al. | |
| 2005/0120789 | A1 | 6/2005 | Matsumoto et al. | |
| 2005/0235970 | A1 | 10/2005 | Carretero | |
| 2005/0257781 | A1 | 11/2005 | Linkenhoger | |
| 2007/0039596 | A1 | 2/2007 | Navalon Carretero | |
| 2007/0062497 | A1 | 3/2007 | Joppig et al. | |

OTHER PUBLICATIONS

"Second Generation ISS Diesel Cold Start Technology with Preheated Intake air," Martin Blanc, Steffen Geiger, Hans Houben, Thomas Hovestadt and Olaf Toedter, MTZ, May 2006, vol. 67, pp. 10-13.

"3946 Half-Bridge Power MOSFET Controller," Allegro MicroSystems, Inc., Data Sheet, Copyright 2003, 2004.

"IR2117(S)/IR2118(S)&(PbF) Single Channel Driver," International Rectifier, Data Sheet No. PD60146 Rev N, Apr. 2, 2004.

* cited by examiner

SOLID STATE SWITCH WITH OVER-TEMPERATURE AND OVER-CURRENT PROTECTION

CROSS-REFERENCE TO RELATED APPLICATIONS

This application is a continuation-in-part of U.S. patent application Ser. No. 11/486,884 filed on Jul. 14, 2006, which claims the benefit of U.S. Provisional Application No. 60/774,893, filed on Feb. 17, 2006. The disclosures of the above applications are incorporated herein by reference in their entirety.

FIELD OF THE INVENTION

The present invention generally relates to an electrical circuit for switching current through resistive loads such as intake air heaters for internal combustion engines.

BACKGROUND

The Background description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present disclosure.

An electrically-powered intake air heater is useful for heating air as it enters the intake of an associated internal combustion engine. Depending on the thermal conditions of the engine and the ambient air, it may be desirable to heat the intake air prior to attempting to start the engine. In some applications the intake air is heated for a predetermined time that is based on the ambient air temperature.

The intake air heater can be turned on and off by a relay or transistor switch that is included in, or controlled by, a heater control module. State of the art heater control module circuits are undesirably limited in their ability to reliably control power to high-power, e.g. greater than 1.5 KW, air heaters.

SUMMARY OF THE INVENTION

An intake air heating system for an internal combustion engine includes an electric heater that heats the intake air, a control circuit that switches a voltage to the electric heater based on a control signal and an over-temperature signal, a temperature sensor that generates a temperature signal based on a temperature of the control circuit, and a temperature sensing circuit that generates the over-temperature signal based on the temperature signal and a predetermined temperature.

In other features the temperature sensor is a thermistor. The predetermined temperature is represented by a voltage that is generated by a voltage divider. The control circuit includes at least one transistor that switches current through the electric heater. The temperature sensor monitors a temperature of the at least one transistor.

In other features a solenoid selectively interrupts current to the electric heater. The solenoid is a spring-loaded pilot duty solenoid.

An intake air heating system for an internal combustion engine includes an electric heater that heats the intake air, a control circuit that switches a voltage to the electric heater based on a control signal and a watchdog timer signal, and a watchdog timer that generates the watchdog timer signal based on a predetermined time and a duration that the control signal commands the electric heater to be on.

In other features the control signal is a pulse-width modulated (PWM) control signal. The predetermined time is greater than a period of the PWM control signal. The predetermined time is represented by a voltage that is generated by a voltage divider. The watchdog timer includes a timer that is reset by the control signal and that generates a time signal. The time signal represents the duration that the control signal commands the electric heater to be on. The timer is a resistor-capacitor (RC) circuit.

An intake air heating system for an internal combustion engine includes an electric heater that heats the intake air, a control circuit that switches a voltage to the electric heater based on a control signal and an overload signal, a load sensing circuit that compares an electrical load of the electric heater to a predetermined load and that generates the overload signal based on the comparison.

In other features the load sensing circuit determines the electrical load based on a voltage of the electric heater. The predetermined load is represented by a voltage that is generated by a voltage divider. The voltage divider is powered by the voltage that is switched to the electric heater.

An intake air heating system for an internal combustion engine includes an electric heater that heats the intake air, a control circuit that generates a gate drive signal, a transistor that switches a voltage to the electric heater based on the gate drive signal, and a rise and fall time control circuit that communicates the gate drive signal to the transistor and that determines a rise time and a fall time of the transistor.

In other features the rise and fall time control circuit includes first and second resistances that determine the rise and fall times.

A method of heating intake air for an internal combustion engine includes switching power to an electric heater based on a control signal and an over-temperature signal, generating a temperature signal based on a temperature of a device that performs the switching function, and generating the over-temperature signal based on the temperature signal and a predetermined temperature.

In other features generating the temperature signal includes varying a resistance based on the temperature of the device. The predetermined temperature is represented by a second voltage. The device is a transistor. The method includes selectively interrupting current to the electric heater based on the control signal. The method includes providing a spring-loaded pilot duty solenoid that selectively interrupts the current to the electric heater.

A method of heating intake air for an internal combustion engine includes switching power to an electric heater based on a control signal and a watchdog timer signal and generating the watchdog timer signal based on a predetermined time and a duration that the control signal commands the electric heater to be on.

In other features the control signal is a pulse-width modulated (PWM) control signal. The predetermined time is greater than a period of the PWM control signal. The predetermined time is represented by a voltage magnitude. The method includes resetting the watchdog timer signal based on the control signal. The control signal indicates a length of time for the electric heater to be on.

A method of heating intake air for an internal combustion engine includes switching power to an electric heater based on a control signal and an overload signal, comparing an electrical load of the electric heater to a predetermined load, and generating the overload signal based on the comparing step.

In other features the electrical load is based on a voltage across the electric heater. The predetermined load is represented by a voltage magnitude. The voltage divider is powered by the power that is switched to the electric heater.

A method of heating intake air for an internal combustion engine includes generating a gate signal for a transistor, conducting the gate signal through a first impedance when the gate signal is turning the transistor on, conducting the gate signal through a second impedance when the gate signal is turning the transistor off, and using the transistor to switch power to an electric heater. A rise time and a fall time of the transistor are based on the first and second impedances, respectively.

In other features the method includes providing first and second resistances to implement the first and second impedances.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
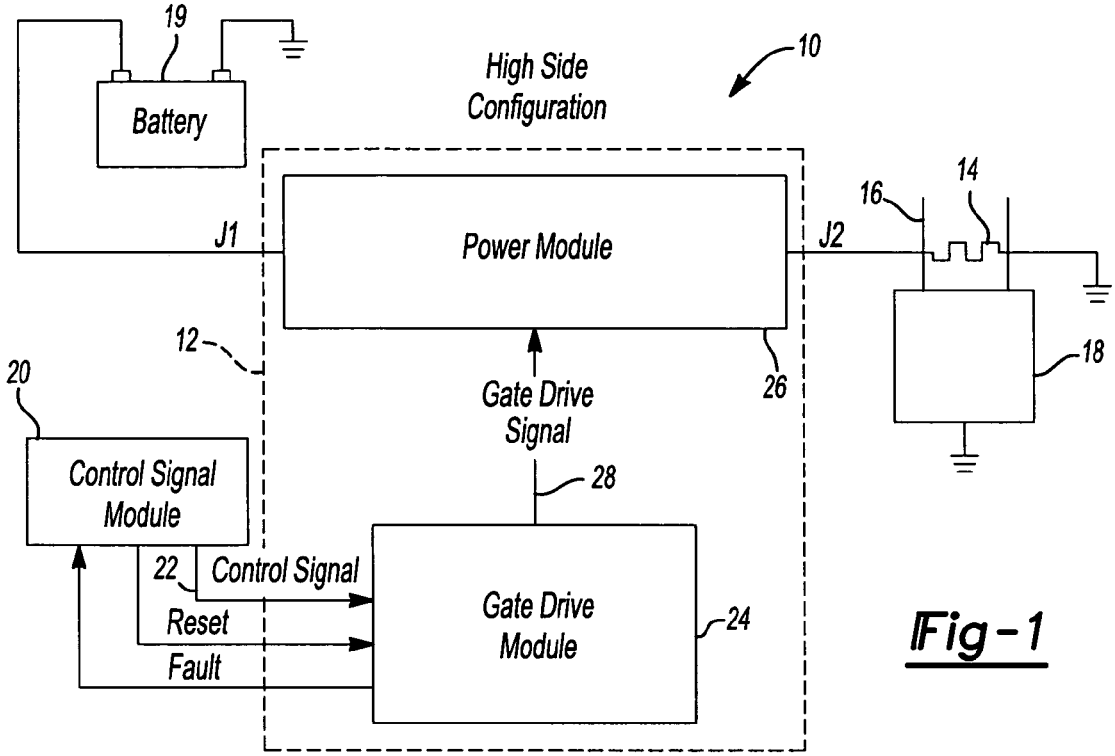
FIG. 1 is a functional block diagram of an intake-air heater system.

The following description is merely exemplary in nature and is in no way intended to limit the disclosure, its application, or uses. For purposes of clarity, the same reference numbers will be used in the drawings to identify similar elements. As used herein, the term module, circuit and/or device refers to an Application Specific Integrated Circuit (ASIC), an electronic circuit, a processor (shared, dedicated, or group) and memory that execute one or more software or firmware programs, a combinational logic circuit, and/or other suitable components that provide the described functionality. As used herein, the phrase at least one of A, B, and C should be construed to mean a logical (A or B or C), using a non-exclusive logical or. It should be understood that steps within a method may be executed in different order without altering the principles of the present disclosure.

Referring now to FIG. 1, an intake air heater system 10 is shown. Heater system 10 includes a heater control module 12 that modulates power to a resistive air heater 14. The modulation can be a pulse width modulation. Air heater 14 can be positioned in an air stream of an inlet tube 16 for an internal combustion engine 18. In some embodiments internal combustion engine 18 can be a diesel engine. Power for air heater 14 can be provided by a battery 19. A control signal module 20 generates a control signal 22 that is communicated to heater control module 12. Heater control module 12 modulates or switches power to air heater 14 based on control signal 22. In some embodiments control signal module 20 can be an engine control module that provides other control signals, e.g. fuel injection signals, to internal combustion engine 18. In some embodiments heater control module 12 can be incorporated with control signal module 20.

Heater control module 12 includes a gate driver module 24 and a power module 26. Gate driver module 24 converts control signal 22 into a gate drive signal 28. Power module 26 modulates or switches current though air heater 14 based on gate drive signal 28.

Figure 2:
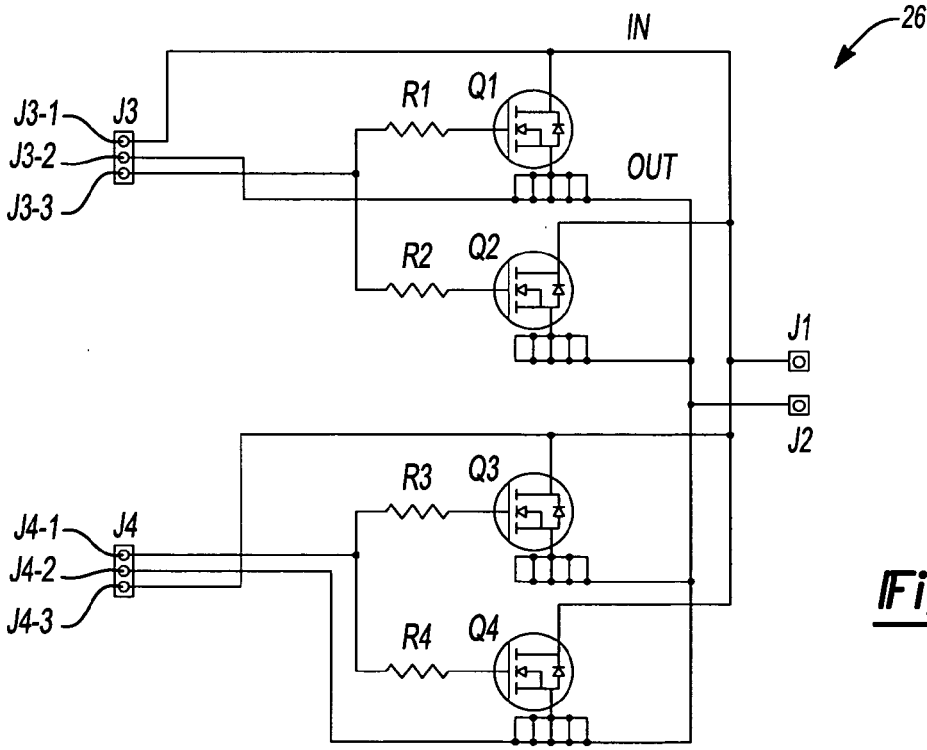
FIG. 2 is a schematic drawing of a power module of the circuit of FIG. 1.

Referring now to FIG. 2, one of several embodiments is shown of power module 26. Power module 26 includes a plurality of transistors Q1-Q4 that switch current flowing through a terminal J1 and a terminal J2. Transistors Q1-Q4 can be field effect transistors (FETs) or insulated gate bipolar transistors (IGBTs). Transistors Q1-Q4 are simultaneously turned on and off by gate drive signal 28. While power module 26 is shown as having four transistors, it should be appreciated by those skilled in the art that power module 26 can include more or fewer transistors. Terminal J1 receives power from battery 19. Terminal J2 provides modulated power to air heater 14. Transistors Q1-Q4 are connected in the circuit such that each transistor conducts an equal amount of the current flowing through terminals J1 and J2.

Power module 26 includes a connector J3 and a connector J4 that can mate with corresponding connectors on gate driver module 24. Connectors J3 and J4 facilitate spacing power module 26 away from gate driver module 24. The spacing provides a thermal barrier between transistors Q1-Q4, which can generate a considerable amount of heat, and gate driver module 24. Connector J3 includes three terminals J3-1, J3-2, and J3-3. Terminal J3-1 communicates with terminal J1 and drains of transistors Q1-Q4. Terminal J3-2 communicates with terminal J2 and sources of transistors Q1-Q4. Terminal J3-3 communicates gate drive signal 28 to transistors Q1-Q2 through respective resistors R1 and R2. Connector J4 includes three terminals J4-1, J4-2, and J4-3. Terminal J4-1 communicates gate drive signal 28 to transistors Q3-Q4 through respective resistors R3 and R4. Terminals J4-2 and J4-3 communicate with terminals J3-2 and J3-1, respectively. Resistors R1-R4 manipulate gate drive signal 28 to control turn-on and/or turn-off times of transistors Q1-Q4.

Figure 3:
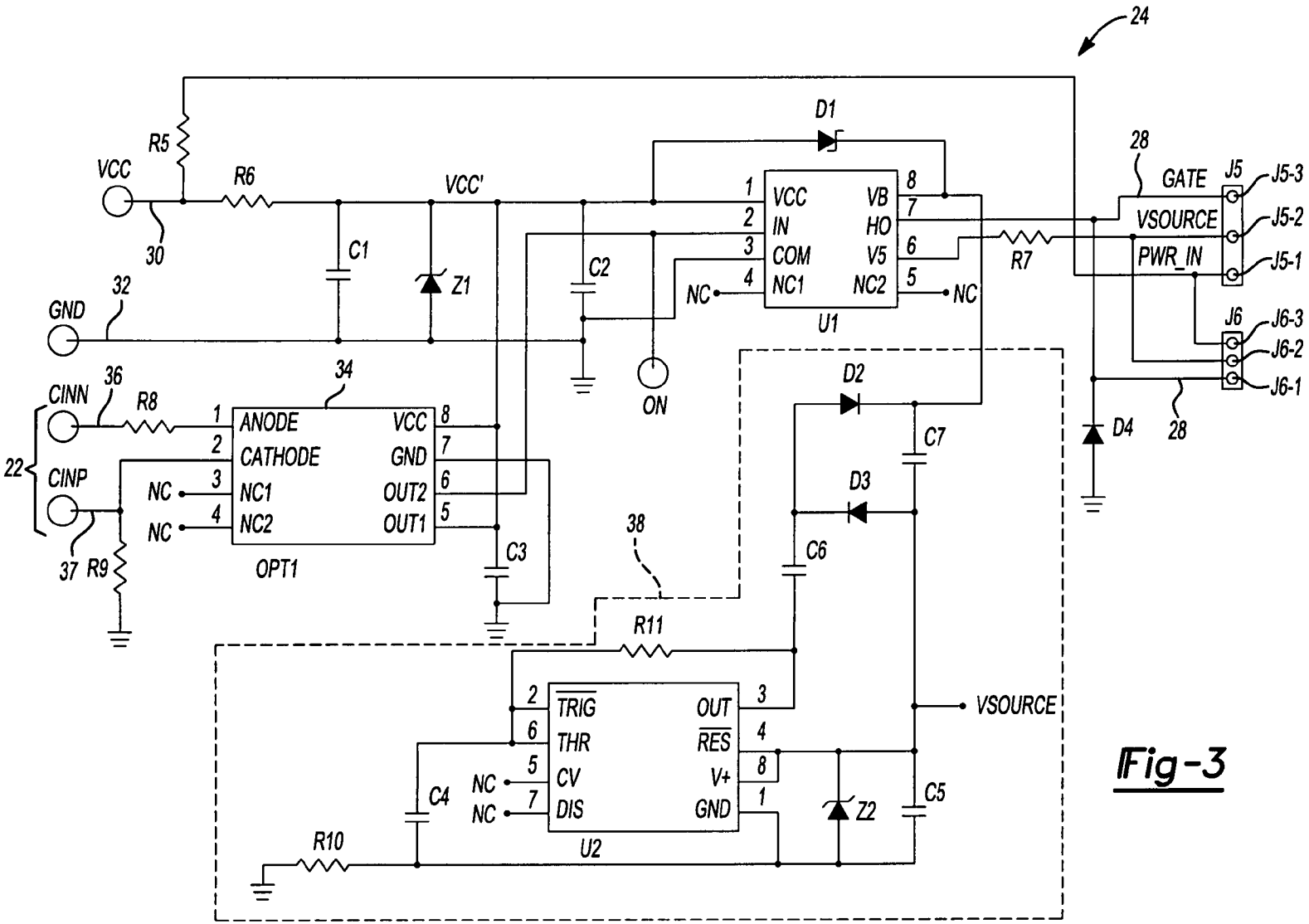
FIG. 3 is a schematic of a first embodiment of a gate driver module of the system of FIG. 1.

Referring now to FIG. 3 a first of several embodiments is shown of gate driver module 24. The first embodiment of gate driver module 24 can generate gate drive signal 28 in one of two modes. A first mode of gate driver module 24 is used when heater control module 12 operates as a solid-state relay and switches power on and off (e.g. 0% or 100% power) to air heater 14. Gate drive module 24 is configured to operate in the first mode by connecting a switch or relay contacts (not shown) across a VCC input terminal 30 and the CINN terminal of gate driver module 24. When the switch is closed heater control module 12 applies 100% power to air heater 14 and when the switch is open heater control module 12 turns off power to air heater 14.

A second mode of gate driver module 24 is assumed for the remainder of this description and is used when heater control module 12 modulates power (e.g. 0-100% power) to air heater 14. Gate drive module 24 is configured to operate in the second mode by leaving VCC input terminal 30 open and applying control signal 22 to a CINN input terminal 36 and a CINP input terminal 37.

Gate driver module 24 includes connectors J5 and J6 that mate with corresponding connectors J3 and J4. Gate driver module 24 receives power from battery 19 via terminals J5-1 and J6-3.

Input terminal 30 communicates with one end of a resistor R5 and one end of a resistor R6. The other end of resistor R5 communicates with a terminal J5-1 and a terminal J6-3. The other end of resistor R6 communicates with one end of a capacitor C1, a cathode of a zener diode Z1, one end of a capacitor C2 and pin 1 of an integrated circuit U1. The cathode of zener diode Z1 clamps a voltage VCC' to input voltage limit of integrated circuit U1. Ground 32 communicates with the other end of capacitor C1, an anode of zener diode Z1, the other end of capacitor C2 and pin 3 of integrated circuit U1. A zener diode D1 connects across pins 1 and 8 of integrated circuit U1 and prevents a charge pump of integrated circuit U1 from exceeding a predetermined voltage that is greater than the voltage of battery 19.

Integrated circuit U1 generates gate drive signal 28 at a voltage higher than the voltage of battery 19 and also isolates power module 26 from a signal that is generated at pin 6 of an optoisolator 34. In some embodiments integrated circuit U1 can be part number IR2117 from International Rectifier, or its equivalent.

Optoisolator 34 electrically isolates control signal 22 from the signal input at pin 2 of integrated circuit U1. Control signal 22 is applied to terminals 36 and 37. Terminal 36 communicates with an anode of optoisolator 34 through a resistor R8. A reference terminal of control signal 22 is applied to a terminal 37. Terminal 37 communicates with a cathode of optoisolator 34. The cathode of optoisolator 34 also communicates with ground 32 through a resistor R9. A power input of optoisolator 34 communicates with a power supply at the cathode of zener diode Z1. A ground terminal of optoisolator 34 communicates with ground 32. A first output (pin 5) and a power supply input (pin 8) of optoisolator 34 communicate with VCC. A capacitor C3 connects across the power supply input of optoisolator 34 and ground 32. A second output at pin 6 of optoisolator 34 communicates with the input terminal of integrated circuit U1. A ground terminal of optoisolator 34 communicates with ground 32. Optoisolator 34 opens and closes a connection between the first output (pin 5) and the second output (pin 6) based on control signal 22.

In some embodiments optoisolator 34 can be eliminated and control signal 22 can be referenced to ground and applied to an ON terminal that communicates with the input at pin 2 of integrated circuit U1.

A charge pump module 38 generates a voltage that is greater than the voltage of battery 19 and supplements the charge pump that is included in integrated circuit U1. The voltage from charge pump module 38 is applied to integrated circuit U1 to assure that integrated circuit U1 can provide current required for 100% duty cycle of gate drive signal 28. Charge pump module 38 includes an integrated circuit U2. In some embodiments integrated circuit U2 can be a 555 timer. Charge pump module 38 includes a resistor R10 with one end connected to ground 32. The other end of resistor R10 connects to ground of integrated circuit U2 and one end of a capacitor C4. The other end of capacitor C4 communicates with threshold and trigger pins of integrated circuit U2 and one end of a resistor R11. The other end of resistor R11 communicates with one end of a capacitor C6 and an output pin of integrated circuit U2. The other end of capacitor C6 communicates with an anode of a diode D2 and a cathode of a diode D3. A capacitor C7 includes a first end that communicates with a cathode of diode D2 and a second end that communicates with an anode of diode D3. An anode of diode D3 communicates with a reset input of integrated circuit U2, a power supply input of integrated circuit U2, a cathode of a zener diode Z2 and terminals J5-2 and J6-2. An anode of zener diode Z2 communicates with ground of integrated circuit U2. A capacitor C5 connects across the power supply input and ground of integrated circuit U2. The output voltage of charge pump module 38 can be taken at the junction of capacitor C7 and the cathode of diode D2.

Gate drive signal 28 can be taken at an output pin 7 of integrated circuit U1. Output pin 7 communicates with terminals J5-3 and J6-1. Integrated circuit U1 receives power from battery 19 via a resistor R7 and terminals J5-2 and J6-2. A cathode of a diode D4 communicates with gate drive signal 28. An anode of diode D4 communicates with ground. Diode D4 prevents a negative voltage from appearing across gate/source junctions of transistors Q1-Q4.

Figure 4:
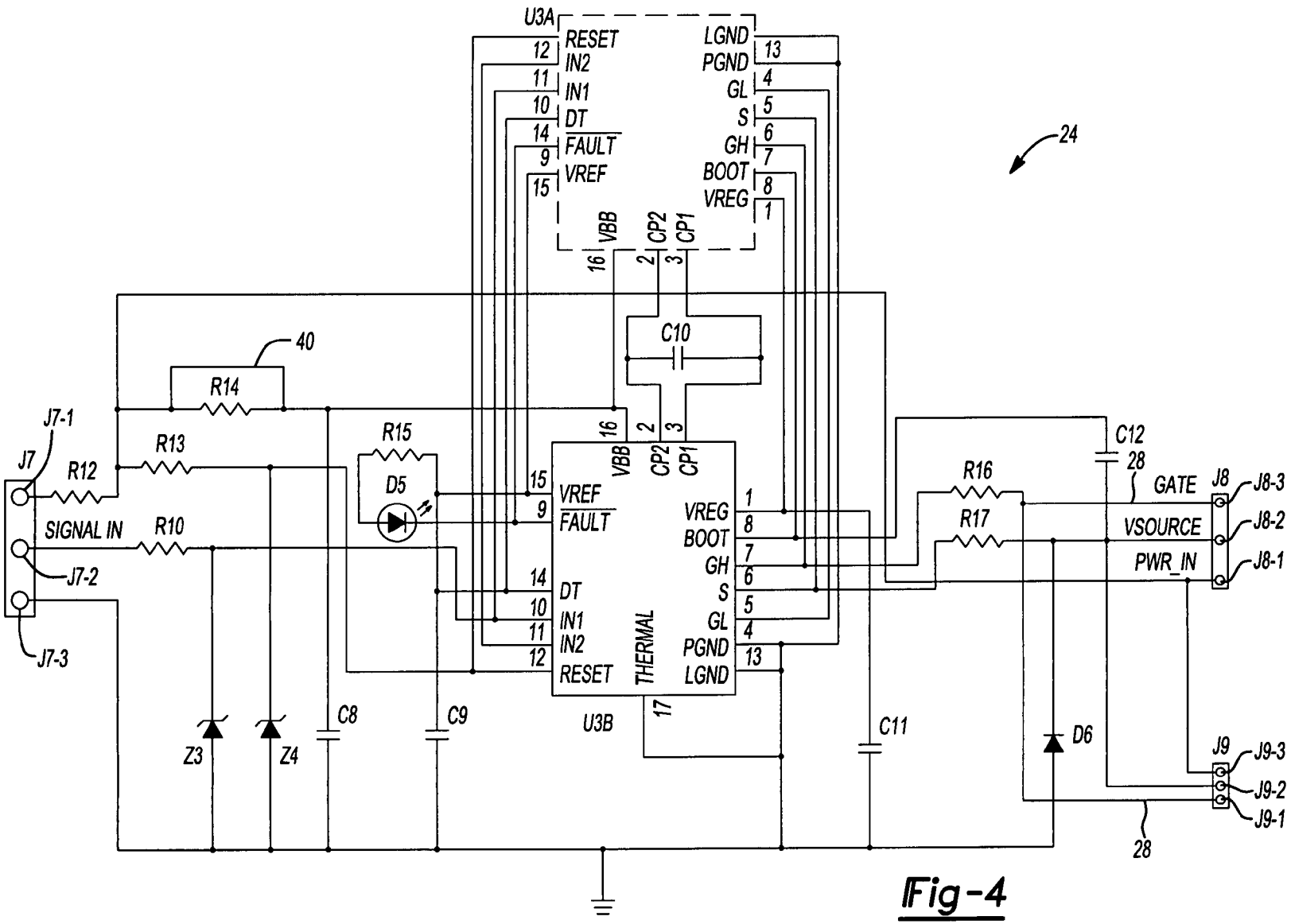
FIG. 4 is a schematic of a second embodiment of a gate driver module of the system of FIG. 1.

Referring now to FIG. 4 a second of several embodiments is shown of gate driver module 24. The second embodiment of gate driver module 24 includes provisions for integrated circuits U3A and U3B. The provisions, such as circuit board pad layouts, for integrated circuits U3A and U3B are electrically equivalent but accommodate different integrated circuit packages. For example, the provisions for integrated circuit U3A can accommodate a small outline integrated circuit package (SOIC) and the provisions for integrated circuit U3B can accommodate a thin shrink small outline package (TSSOP) package. In practice only one of integrated circuits U3A and U3B is used. The provisions for two types of integrated circuit packages allow a manufacturer of the second embodiment of gate driver module 24 to choose the integrated circuit package based on factors such as market price and/or availability. The description below assumes that integrated circuit U3B is populated in the circuit, however it should be appreciated the description also applies to integrated circuit U3A.

A connector J7 includes a terminal J7-2 that receives control signal 22. Terminal J7-2 communicates with one end of a resistor R10. The other end of resistor R10 communicates with a cathode of a zener diode Z3 and an input of an integrated circuit U3B. In some embodiments integrated circuit U3B can be part number 3946 from Allegro Microsystems, Inc., or its equivalent. An anode of zener diode Z3 communicates with ground 32.

A terminal J7-3 communicates with ground 32. A terminal J7-1 communicates with one end of a resistor R12. The other end of resistor R12 receives battery power via a terminal J8-1 and/or a terminal J9-3. A connector J8 and a connector J9 mate with connectors J3 and J4, respectively, of power module 26 (FIG. 2). The other end of resistor R12 communicates with one end of a resistor R13 and one end of a resistor R14. In some embodiments resistor R14 can be bypassed with a jumper 40. The second end of resistor R13 communicates with a cathode of a zener diode Z4 and a reset terminal of integrated circuit U3B. A second end of resistor R14 communicates with one end of a capacitor C8 and a supply voltage input (VBB) of integrated circuit U3B. The other end of capacitor C8 and an anode of zener diode Z4 communicate with ground 32.

Integrated circuit U3B accommodates a wide voltage range of battery 19 to assure that transistors Q1-Q4 can be fully turned on even when the voltage of battery 19 is less than nominal. For example, the voltage of battery 19 can dips significantly while air heater 14 is turned on and integrated circuit U3B assures that transistors Q1-Q4 do not operate in the linear mode except during brief moments during turn-on and turn-off.

Integrated circuit U3B includes a charge pump module that generates a voltage at a pin VREG. VREG is regulated to a predetermined voltage such as 13 V nominal. When a VBB pin of integrated circuit U3B is <8 V, the charge pump module operates as a voltage doubler. When VBB is between 8V and 15V the charge pump module operates as a voltage doubler/PWM, current-controlled, voltage regulator. When VBB is greater than 15 V the charge pump module operates as a PWM, current-controlled, voltage regulator. The charge pump module communicates with a charge pump capacitor C10.

A bootstrap charge pump module charges a capacitor C12. Capacitor C12 connects to a bootstrap input at pin 8 of integrated circuit U3B and terminals J8-2 and J9-2. The bootstrap charge pump module and the charge stored in capacitor C12 can supplement the first charge pump module of integrated circuit U3B to assure that integrated circuit U3B can fully turn on transistors Q1-Q4 at 100% duty cycle. An output voltage of the bootstrap charge pump module is based on a load voltage sensed at input pin S of integrated circuit U3B. The output voltage is referenced or bootstrapped to the voltage of battery 19.

Pin S communicates with one end of a resistor R17. The other end of resistor R17 communicates with terminals J8-2 and J9-2. A cathode of a diode D6 communicates with the terminals J8-2 and J9-2. An anode of diode D6 communicates with ground 32. Diode D6 prevents the voltage of sources of transistors Q1-Q4 from going less than a diode drop below ground 32. A capacitor C11 connects across ground 32 and a power input at pin 1 of integrated circuit U3B.

Integrated circuit U3B can detect internal fault conditions and indicate the fault conditions through a fault output at pin 9. Examples of faults include under-voltage of the bootstrap charge pump (e.g. if capacitor C12 discharges enough to prevent fully turning on transistors Q1-Q4) and/or a temperature of integrated circuit U3B exceeding a predetermined temperature. In some embodiments an LED D5 can communicate with integrated circuit U3B. LED D5 illuminates and/or flashes to indicate a fault condition. A current-limiting resistor R15 can be connected in series with LED D5. In some embodiments the fault output can communicate with control signal module 20 (shown in FIG. 1). In such an embodiment control signal module 20 can take action, such as turning off air heater 14 and/or altering a control strategy for internal combustion engine 18. In some embodiments the fault signal can be communicated to control signal module 20 via a communication network such as CAN and SAE J1850.

An output signal of integrated circuit U3B appears at a high-side output pin 7 and is applied to one end of a resistor R16. The other end of resistor R16 provides the gate signal to terminals J8-3 and J9-1. Integrated circuit U3B can include a thermal slug that conducts heat from an interior of integrated circuit of U3B. The thermal slug, which is identified as pin 17, can be connected to ground 32 to reduce noise in integrated circuit U3B that is generated by electromagnetic fields.

Figure 5:
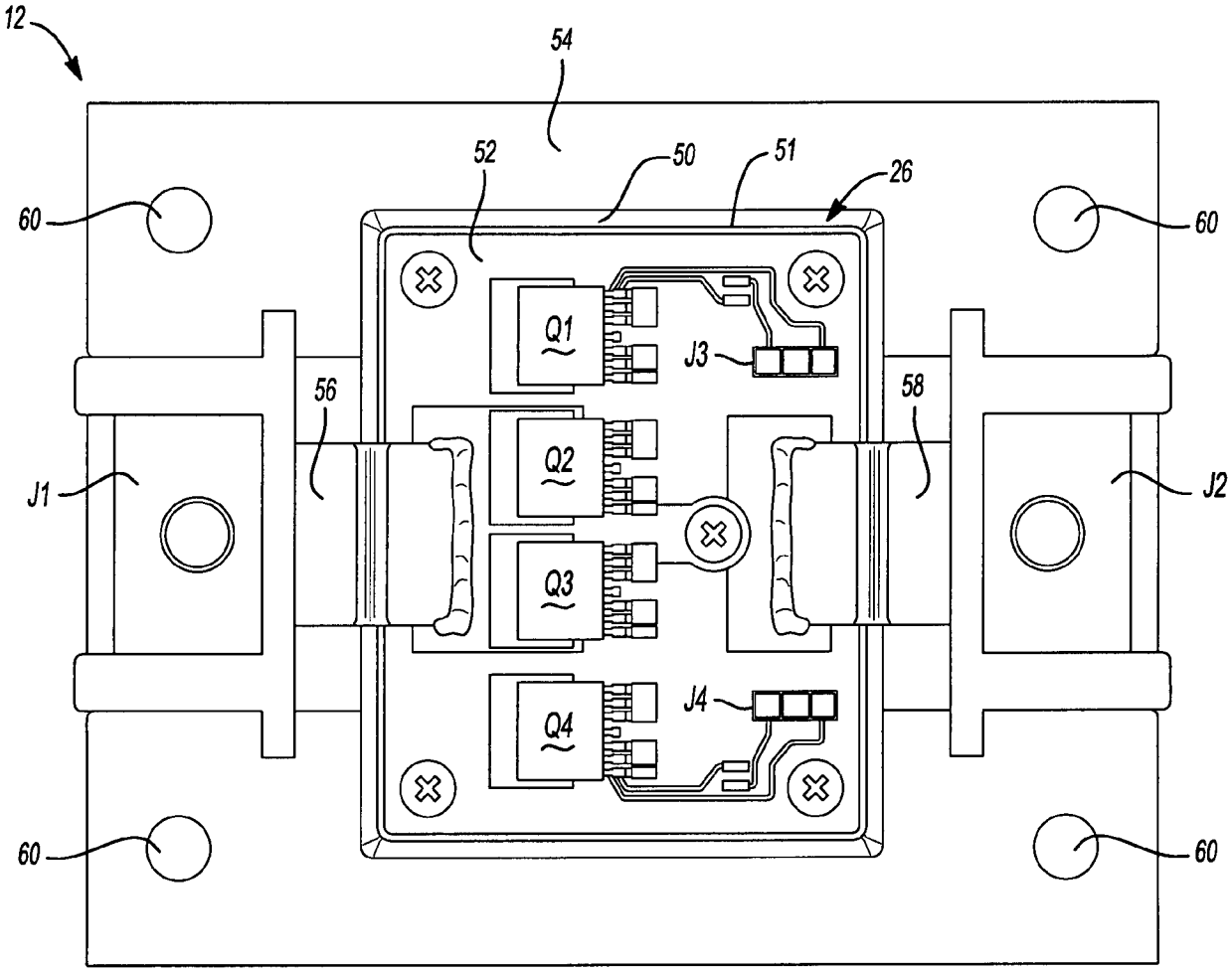
FIG. 5 is a plan view of a protective housing and thermal mass for the power module of FIG. 2.

Referring now to FIG. 5, one of several embodiments is shown of heater control module 12. A thermal mass 54, such as aluminum, includes a recess 50. Thermal mass 54 may be formed by casting, extrusion, and/or machining from a block of material. Thermal mass 54 houses heater control module 12 and absorbs heat from gate driver module 24 and power module 26. In some embodiments thermal mass 54 is sized such that it has enough thermal capacity to be free of heat sink fins and/or pins while keeping dies of transistors Q1-Q4 at or below their maximum operating temperature. Such a design allows thermal mass to provide sufficient cooling even when covered in mud and/or other debris that may be encountered in a vehicle environment and/or proximity of internal combustion engine 18. Thermal mass 54 may also include heat sink fins and/or pins.

Power module 26 is assembled on a printed circuit board (PCB) 52 that is mounted to a base of the recess 50. A thermal-conducting pad 51 can be positioned between PCB 52 and the base of recess 50. In some embodiments PCB 52 includes a low thermal impedance dielectric layer such as thin FR-4 and/or a high-temperature material such as polyamide. The dielectric layer includes circuit traces that connect the various components of power module 26. PCB 52 also includes a thermal layer that is formed from a material such as copper or aluminum and mated to the dielectric layer. An example construction of PCB 52 includes T-Clad sold by The Bergquist Company. An example of thermal-conducting pad 51 includes Q-pad sold by the Bergquist Company.

The base of recess 50 conducts heat away from PCB 52 and into thermal mass 54. Terminals J1 and J2 are electrically insulated from thermal mass 54 and communicate with power module 26 through respective leads 56 and 58. Leads 56 and 58 can be integrally formed with terminals J1 and J2 and soldered to circuit traces of PCB 52. Thermal mass 54 may be secured to other structures using one or more of mounting holes 60. In some embodiments thermal mass 54 may be fastened to, or integrally formed with, air heater 14.

Gate driver module 24 (not shown) can be assembled on a PCB that lies parallel with PCB 52. Connectors J3 and J4 are oriented to mate with connectors J8 and J9 (or J5 and J6, depending on a selected embodiment of gate driver module 24) of gate driver module 24.

Figure 6:
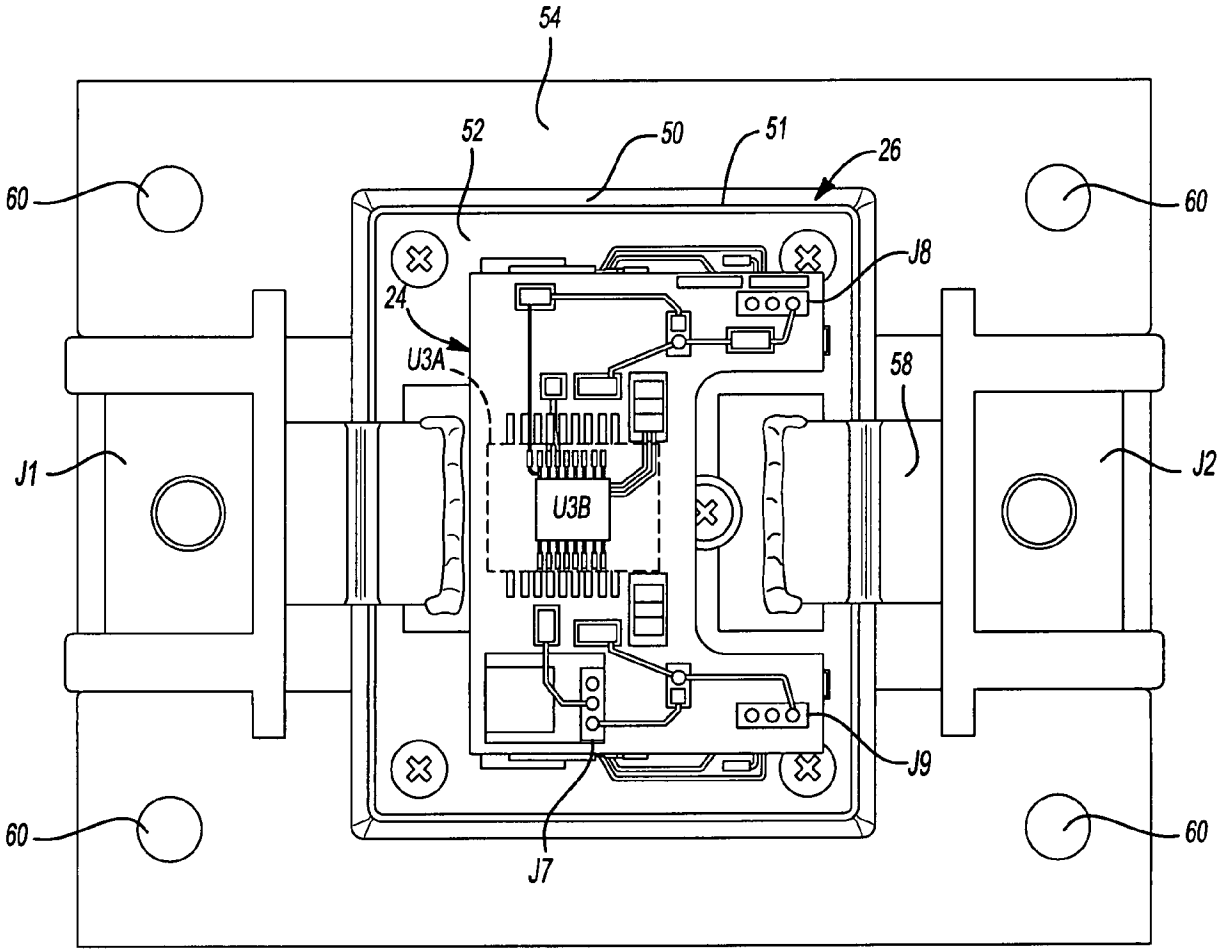
FIG. 6 is a plan view of the protective housing and thermal mass of FIG. 5 that includes the gate driver module of FIG. 4.

Referring to FIG. 6, heater control module 12 is shown in plan view with gate driver module 24 connected to terminals J3 and J4 of power module 26. Recess 50 may be filled with a potting material that protects gate driver module 24 and power module 26 from weather and/or contaminants. A cover (not shown) may also be secured to thermal mass 54 to enclose recess 50 and further protect gate driver module 24 and power module 26. The cover can include holes that align with holes 60 such that the cover can be secured by the mounting screws for thermal mass 54.

Figure 7:
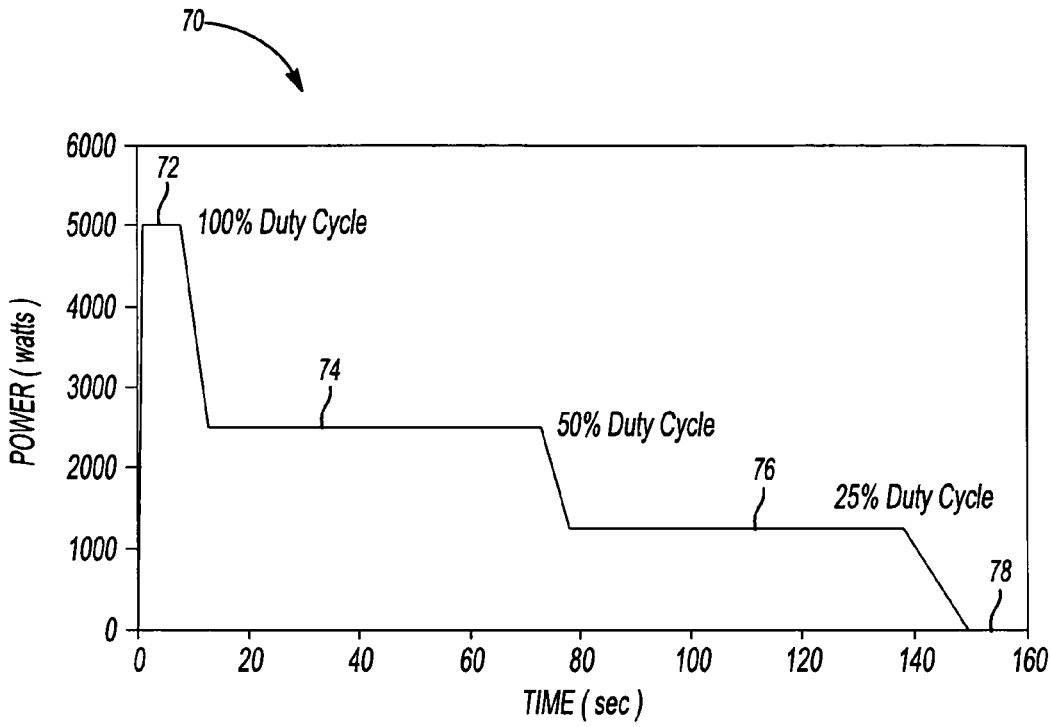
FIG. 7 is a timing chart showing an example of heater power as a function of time.

Referring now to FIG. 7, a timing chart 70 shows an example power profile for air heater 14. A vertical axis indicates power in watts. A horizontal axis indicates time in seconds. The power can be determined by control signal module 20 and communicated to heater control module 12 via control signal 22.

During a period 72 air heater 14 is turned on with gate drive signal 28 having a 100% duty cycle. Period 72 occurs prior to internal combustion engine 18 being started. Period 72 allows time for the air in inlet tube 16 to be heated and thereby improve fuel vaporization and/or combustion when internal combustion engine 18 is started. At the end of period 72, which can last about ten seconds, internal combustion engine 18 is started and the duty cycle of gate drive signal 28 is reduced to about 50% to begin a second period 74. During second period 74 air heater 14 heats air flowing though inlet tube 16. Second period 74 can last about 70 seconds. A third period 76 follows second period 74. During third period 74 internal combustion engine 18 generates sufficient heat in inlet tube 16 to allow the duty cycle of gate drive signal 28 to be reduced to about 25%. The duration of third period 76 can be about 60 seconds. After third period 76 the duty cycle of gate drive signal 28 can be reduced to zero during a fourth period 78. Fourth period 78 terminates when internal combustion engine 18 is turned off. It should be appreciated the durations and/or duty cycles of periods 72-76 can be varied and/or eliminated based on ambient air temperature and/or a starting temperature of internal combustion engine 18. Worst-case (i.e. highest) duty cycles and durations of periods 72-76, thermal properties of transistors Q1-Q4 and PCB 52, and worst-case ambient temperature can be used to determine a mass of thermal mass 54.

Figure 8:
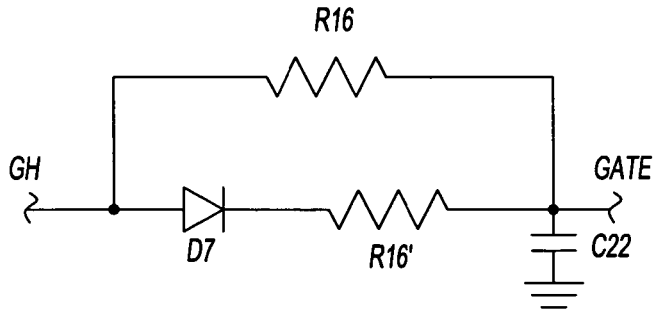
FIG. 8 is a schematic of a circuit for independently controlling rise and fall times of transistors in the power module.

Referring now to FIG. 8, a circuit is shown for independently controlling the rise and fall times of transistors Q1-Q4. The circuit includes a diode D7 and a resistor R16' that are connected in series. The series combination of diode D7 and resistor R16' can be connected in parallel with resistor R16 that is also shown in FIG. 4. When integrated circuit U3B drives the GH signal high, the gates of transistors Q1-Q4 are charged through the parallel combination of resistors R16 and R16'. When integrated circuit U3B drives the GH signal low, the gates of transistor Q1-Q4 discharge through resistor R16 because the diode D7 blocks current flow through resistor R16'. Since the resistance that is in series with the gates of transistors Q1-Q4 has the value of R16||R16' when Q1-Q4 are turned on and the value of R16 when transistors Q1-Q4 are turned off, the rise and fall times of transistor Q1-Q4 are also different and programmable via R16 and R16'. The rise and fall times can be varied to minimize the voltage and current transients, while controlling die temperatures of transistor Q1-Q4. In some embodiments one end of a capacitor C22 can be coupled to the junction of R16 and R16' and the other end of capacitor C22 can be coupled to ground 32. Capacitances of capacitor C22 can be used to match slew rates for different transistors sets Q1-Q4.

Figure 9:
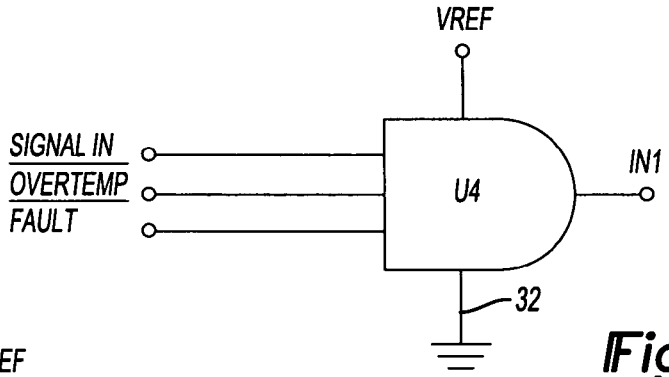
FIG. 9 is a schematic of a circuit for gating a control signal of the gate driver module.

Referring now to FIG. 9, a logic gate U4 is shown that can be used to gate the SIGNAL IN signal that is applied to pin 10 of integrated circuit U3B. By gating the SIGNAL IN signal logic gate U4 provides a means for disabling transistors Q1-Q4 under certain fault conditions.

Logic gate U4 includes three inputs and one output. The first input receives the SIGNAL IN signal from resistor R10. The second and third inputs receive respective $\overline{\text{OVERTEMP}}$ and $\overline{\text{FAULT}}$ signals from a temperature sensing circuit and from a fault latch circuit that are described below. The output of logic gate U4 communicates with pin 10 of integrated circuit U3B. Logic gate U4 prevents the SIGNAL IN signal from reaching pin 10 of integrated circuit U3B when the temperature sensing circuit and/or the fault latch circuit pulls low its respective input of logic gate U4.

Figure 10:
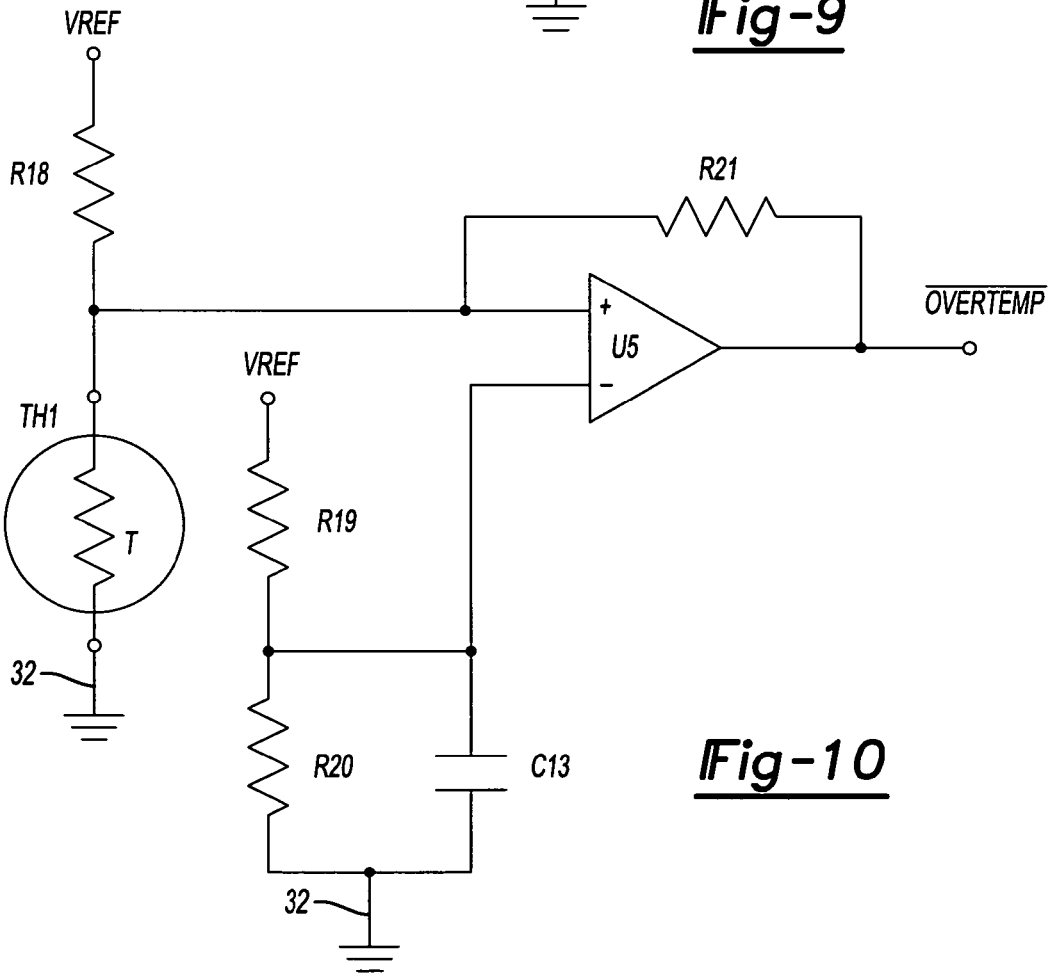
FIG. 10 is a schematic of a temperature sensing module.

Referring now to FIG. 10, an implementation is shown of the temperature sensing circuit. The temperature sensing circuit includes a temperature sensor, such as a thermistor TH1 that senses the temperature of power module 26. The temperature sensing circuit asserts the $\overline{\text{OVERTEMP}}$ signal when the temperature of power module 26 exceeds a predetermined temperature. The $\overline{\text{OVERTEMP}}$ signal can be applied to an input of logic gate U4 and thereby used to turn off transistors Q1-Q4 during a fault condition. In some embodiments thermistor TH1 is positioned proximate transistors Q1-Q4 so as to indicate their temperatures. For example, thermistor TH1 can be mounted on PCB 52 between transistors Q2 and Q3 (see FIG. 5.)

The temperature sensing circuit includes a first voltage divider that includes a resistor R18 in series with thermistor TH1. The first voltage divider is powered by VREF and referenced to ground 32. A voltage tap of the first voltage divider communicates with a non-inverting input of a comparator U5.

A second voltage divider includes a resistor R19 in series with a resistor R20. The second voltage divider is also powered by VREF and referenced to ground 32. A voltage tap of the second voltage divider establishes a reference voltage that is communicated to an inverting input of comparator U5. The reference voltage represents a predetermined maximum operating temperature for power module 26.

As the temperature at thermistor TH1 rises the voltage decreases at the non-inverting input of comparator U5. The output of comparator U5 is normally high. When the temperature at TH1 exceeds the reference voltage then the voltage at the non-inverting input of comparator U5 becomes less than the reference voltage and causes the output of comparator U5 to go low. A feedback resistor R21 can be coupled between the output and the non-inverting input of comparator U5. Resistor R21 provides hysteresis that prevents the output of comparator U5 from switching excessively when the reference voltage and the voltage from thermistor TH1 are approximately equal. A capacitor C13 can be coupled between the inventing input of comparator U5 and ground 32. Capacitor C13 filters the reference voltage.

Figure 11:
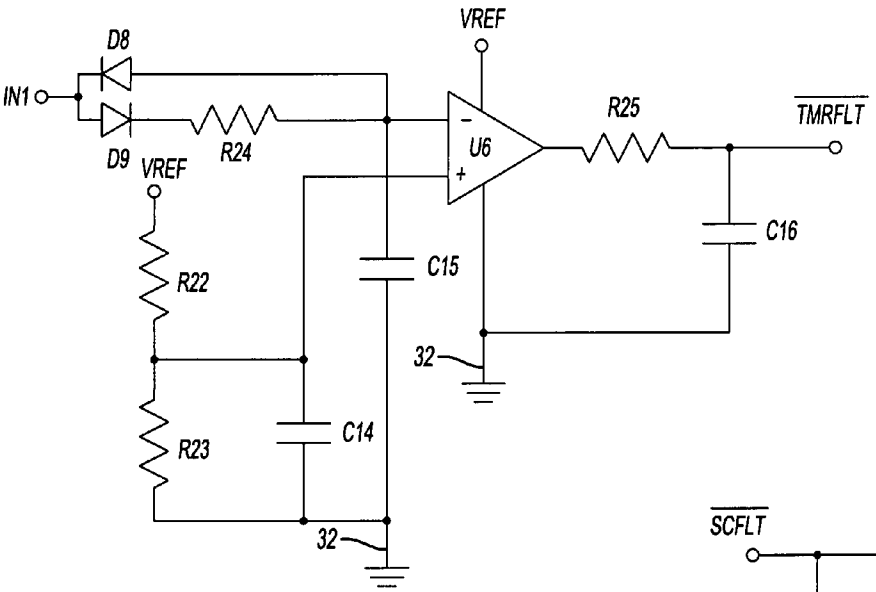
FIG. 11 is a schematic of a watchdog timer module.

Referring now to FIG. 11, a watchdog timer circuit is shown. The watchdog timer circuit turns off transistors Q1-Q4 if the SIGNAL IN signal remains high longer than a predetermined time. The watchdog timer circuit includes a voltage divider that includes a resistor R22 in series with a resistor R23. The voltage divider can be powered by VREF and referenced to ground 32. A voltage tap of the voltage divider provides a reference voltage that is communicated to a non-inverting input of comparator U6. A capacitor C14 can filter the reference voltage.

The watchdog timing function is generated by a RC circuit. The RC circuit includes a resistor R24 that is connected in series with a capacitor C15. The RC circuit has an input at one end of resistor R24 and is referenced to ground at the other end of capacitor C15. The time interval is determined by the time required for the IN1 signal to charge capacitor C15, and is taken at the connection between resistor R24 and capacitor C15 and communicated to an inverting input of comparator U6. The values of resistors R22, R23, R24 and capacitor C15 should be chosen so that the output of comparator U6 remains high for any anticipated frequency and duty cycle of the IN1 signal, which can be taken from the output of logic gate U4.

In some embodiments an anode of a diode D9 can be coupled to the IN1 signal and a cathode of the diode D9 can be coupled to one end of resistor R24. An anode of a second diode D8 can be coupled to the junction of resistor R24 and a capacitor C15. A cathode of diode D8 can be connected to the IN1 signal. Diode D8 provides a path for rapidly discharging capacitor C15 when the IN1 signal goes low. The discharging resets the watchdog timer circuit and thereby synchronizes the RC timer with the IN1 signal. An output of comparator U6 can be coupled to one end of a resistor R25. The watchdog timer generates and an output signal $\overline{\text{TMRFLT}}$ that can be taken at the other end of resistor R25. The $\overline{\text{TMRFLT}}$ signal can be filtered by a capacitor C16 that is coupled to ground.

Figure 12:
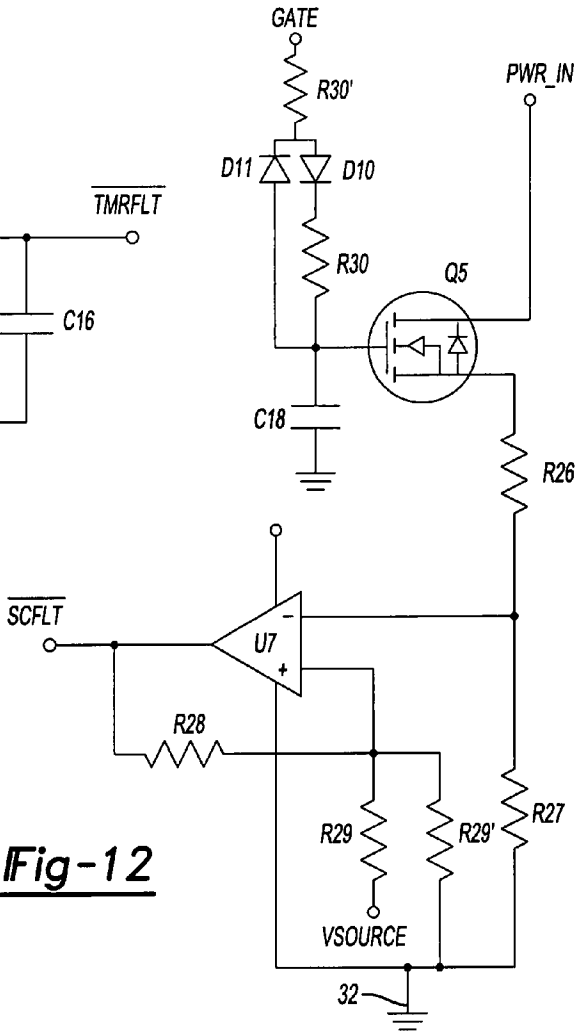
FIG. 12 is a schematic of a current-sense module.

Referring now to FIG. 12, a circuit is shown that detects a short circuit in air heater 14. The circuit includes a first voltage divider that is formed by a resistor R26 and a resistor R27.

A transistor Q5 switches the PWR_IN signal to the first voltage divider. The first voltage divider is referenced to ground 32. A reference voltage is taken at a tap of the first voltage divider.

Transistor Q5 is turned on and off by the GATE signal which is also applied to the gates of transistors Q1-Q4. An anode of a diode D10 communicates with the GATE signal through resistor R30'. A cathode of the diode D10 communicates with one end of a resistor R30. A second end of resistor R30 communicates with a gate of transistor Q5. An anode of a diode D11 communicates with the gate of transistor 05. A cathode of diode D11 communicates with the GATE signal through resistor R30'. One end of a capacitor C18 can communicate with the gate of transistor Q5. The other end capacitor C18 communicates with ground 32.

The GATE signal charges the gate of transistor Q5 through resistor R30', diode D10, and resistor R30. The gate of transistor Q5 discharges through diode D11 and resistor R30'. The rise and fall times of transistor Q5 can therefore be controlled with the values of capacitor C18, resistor R30', and resistor R30.

A comparator U7 includes an inverting input that receives the reference voltage from the first voltage divider of resistors R26 and R27. Comparator U7 also includes a non-inverting input that receives a voltage proportional to VSOURCE through a resistors R29 and R29'. VSOURCE is the voltage at the sources of transistors Q1-Q4. A feedback resistor R28 connects between an output of comparator U7 and the non-inverting input of comparator U7. A signal $\overline{\text{SCFLT}}$ can be taken at the output of comparator U7. The $\overline{\text{SCFLT}}$ signal goes low when the circuit detects a short across air heater 14.

During operation, the output of comparator U7 goes low when the GATE signal is high and VSOURCE produces a voltage at the non-inverting input of U7 that falls bellow the reference voltage established by the voltage divider of resistors R26 and R27. A low voltage at the output of comparator U7 indicates that the circuit of air heater 14 is drawing excessive current and possibly short-circuited.

Figure 13:
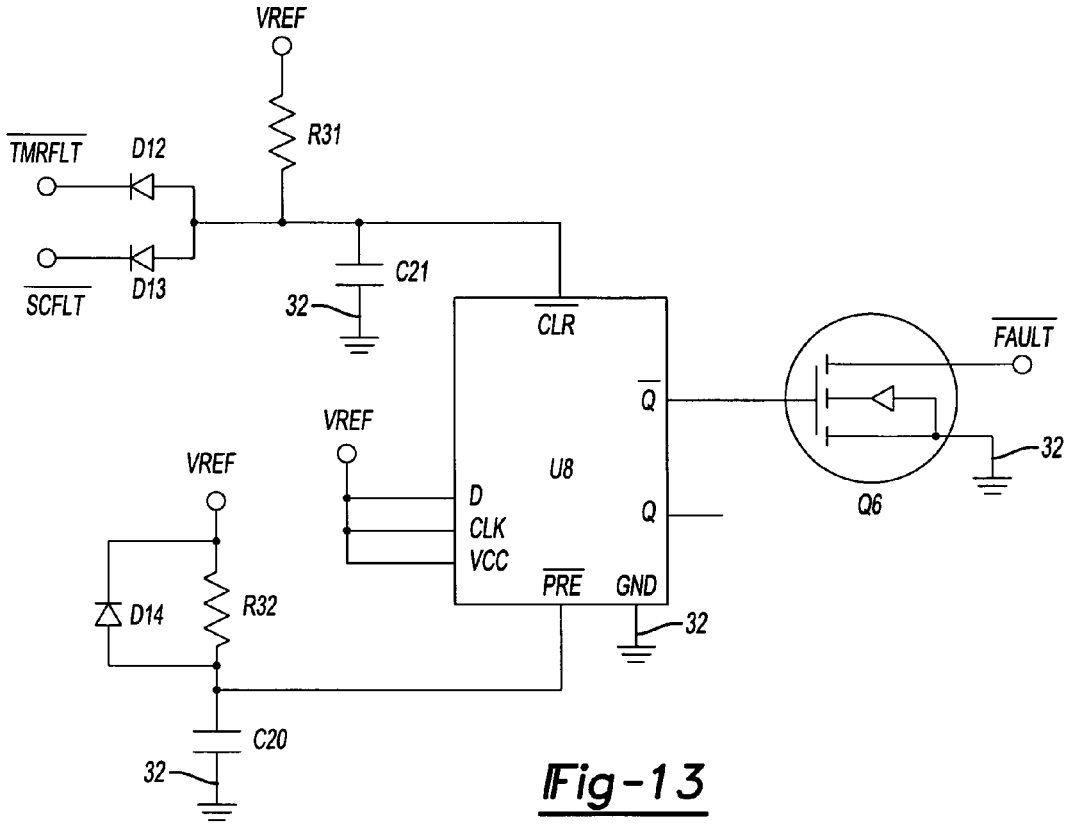
FIG. 13 is a schematic of a fault latch module.

Referring now to FIG. 13, a latch circuit is shown that latches fault signals $\overline{\text{TMRFLT}}$ and $\overline{\text{SCFLT}}$ from the watchdog timer circuit of FIG. 11 and/or the short-circuit detection circuit of FIG. 12, respectively. The latched fault signal is communicated to an input of logic gate U4 (see FIG. 9) and causes transistors Q1-Q4 to be turned off when it is low. In some embodiments the fault signal can be communicated to a fault output signal at connector J7 (see FIG. 4). A terminal can be added to connector J7 to accommodate the fault output signal.

The latch circuit receives the $\overline{\text{TMRFLT}}$ signal at a cathode of a diode D12 and receives the $\overline{\text{SCFLT}}$ signal at a cathode of a diode D13. An anode of diode D12 communicates with an anode of diode 13 and a clear ($\overline{\text{CLR}}$) input of a flip-flop (FF) U8. A resistor R31 pulls up the $\overline{\text{CLR}}$ input of FF U8. One end of a capacitor 32 communicates with the $\overline{\text{CLR}}$ input and the other end communicates with ground 32. Capacitor C21 prevents transients from being latched in as hard faults. A $\overline{\text{Q}}$ output of FF U8 communicates with a gate of a transistor Q6. When the $\overline{\text{CLR}}$ input of FF U8 goes low, the $\overline{\text{Q}}$ output of FF U8 latches high and is communicated to the gate of transistor Q6. When the gate of transistor Q6 goes high the source of transistor Q6 communicates ground 32 to the drain of Q6. The ground level generated at the drain of transistor Q6 produces the $\overline{\text{FAULT}}$ signal that disables input 3 of logic gate U4 (see FIG. 9) and causes transistors Q1-Q4 to be turned off.

A resistor R32 and a capacitor C20 form an RC timing circuit that allows FF U8 to clear a latched condition each time VREF is removed and restored. The RC timing circuit is powered by VREF and referenced to ground 32. A cathode of a diode D14 can be connected to VREF and one end of resistor R32. An anode of diode D14 can be connected to the other end of resistor R32. The signal taken at the junction of resistor R32 and capacitor C20 is communicated to the PRESET input of FF U8. The time required for VREF to charge capacitor C20 through resistor R32 allows FF U8 to power up and preset the $\overline{\text{Q}}$ output low.

Figure 14:
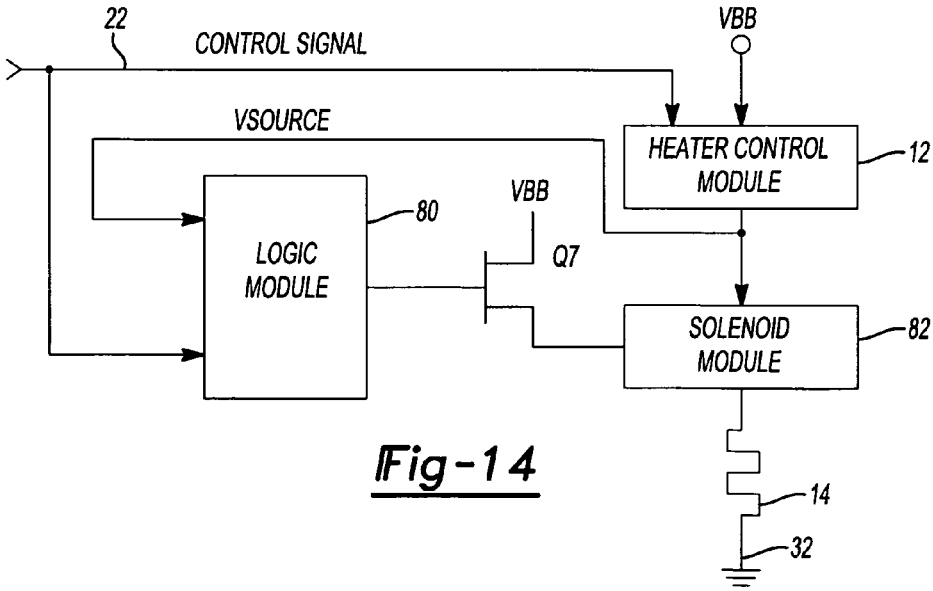
FIG. 14 is a schematic of a contactor module.

Referring now to FIG. 14, a circuit is shown that can interrupt current flow through air heater 14 in the event one or more of transistors Q1-Q4 fails in a shorted condition. The circuit includes a logic module 80 that receives the VSOURCE signal from transistors Q1-Q4 and receives control signal 22. Logic module 80 generates an output signal based on control signal 22 and VSOURCE. The output signal communicates with a gate of a transistor Q7. A drain of transistor Q7 communicates with the voltage of battery 19, VBB. A source of transistor Q7 communicates with an input of a spring-loaded pilot duty solenoid 82.

Under normal operation solenoid 82 conducts current that flows through air heater 14. In the event of a fault, such as the short circuit failure of one or more of transistors Q1-Q4, there would be current flow through air heater 14 even though control signal 22 and heater module 12 are turned off. Logic module 80 therefore monitors for a fault condition wherein control signal 22 is off or requesting that air heater 14 be turned off, however the VSOURCE signal indicates that air heater 14 is turned on. Under this fault condition logic module 80 turns on transistor Q7. Transistor Q7 then causes solenoid 82 to open and remove power from air heater 14. Solenoid 82 can be mechanically reset to restore power to air heater 14.

What is claimed is:

1. An intake air heating system for an internal combustion engine, the intake air heating system comprising:

an electric heater that heats the intake air;

a control circuit that is arranged in a current path between a supply voltage and the electric heater, wherein the control circuit includes a switch that selectively interrupts the current path based on a control signal and an over-temperature signal;

a solenoid module that is in series with the control circuit and the electric heater, wherein the solenoid module selectively interrupts the current path to the electric heater;

a temperature sensor that senses a temperature of h control circuit and generates a temperature signal based on the temperature of the control circuit; and a temperature sensing circuit that generates the over-temperature signal based on a comparison of the temperature signal and a predetermined temperature.

2. The intake air heating system of claim 1 wherein the temperature sensor comprises a thermistor.

3. The intake air heating system of claim 1 wherein the predetermined temperature is represented by a voltage that is generated by a voltage divider.

4. The intake air heating system of claim 1 wherein the switch includes at least one transistor and wherein the temperature sensor monitors a temperature of the at least one transistor.

5. The intake air heating system of claim 1 wherein the solenoid module comprises a spring-loaded pilot duty solenoid.

6. The intake air heating system of claim 5 wherein, after the solenoid module interrupts the current path to the electric heater, the solenoid module restores the current path to the electric heater upon being mechanically reset.

7. The intake air heating system of claim 1 further comprising a logic module that selectively controls the solenoid module to interrupt the current path to the electric heater.

8. The intake air heating system of claim 7 wherein the logic module is configured to connect a voltage source to the solenoid module in order to control the solenoid module to interrupt the current path to the electric heater.

9. The intake air heating system of claim 7 wherein the logic module selectively controls the solenoid module to interrupt the current path to the electric heater based on the control signal.

10. The intake air heating system of claim 9 wherein the logic module controls the solenoid module to interrupt the current path to the electric heater when the control signal instructs the control circuit to turn off the electric heater and a voltage measurement indicates that the electric heater is on.

11. The intake air heating system of claim 9 wherein the logic module controls the solenoid module to interrupt the current path to the electric heater when the control signal instructs the control circuit to turn off the electric heater and a current measurement indicates that the electric heater is on.

12. The intake air heating system of claim 1 wherein the solenoid module is in series between the control circuit and the electric heater.

13. The intake air heating system of claim 1 further comprising a logic module that controls the solenoid module, wherein the logic module controls the solenoid module to interrupt the current path when (i) the control signal instructs the control circuit to interrupt the current path but (ii) a measurement of the current path indicates that current is flowing in the current path.

14. The intake air heating system of claim 1 further comprising a short circuit module that generates a short circuit signal based on a comparison of a voltage across the electric heater and a reference voltage, wherein the control circuit interrupts the current path based on generation of the short circuit signal.

15. The intake air heating system of claim 14 further comprising a watchdog module that generates a timer fault signal when a length of time exceeds a predetermined time, wherein the length of time measures how long the control signal has instructed the electric heater to be on continuously, and wherein the control circuit interrupts the current path based on generation of the timer fault signal.

16. The intake air heating system of claim 15 further comprising a latch module that generates a disable signal in response to generation of either of the short circuit signal and the timer fault signal, wherein the control circuit interrupts the current path based on generation of the disable signal.

17. The intake air heating system of claim 16 wherein the latch module stops generating the disable signal when power to the latch is removed, and does not generate the disable signal again until one of the short circuit signal or the timer fault signal is generated.

18. A method of heating intake air for an internal combustion engine, the method comprising:

selectively switching power to an electric heater, using a switching device, based on a control signal and an over-temperature signal, wherein the switching device is arranged in series between the electric heater and a source of the power;

using a solenoid module in series with the switching device and the electric heater to selectively interrupt current to the electric heater based on the control signal;

measurin atu e of the switchini device;

generating a temperature signal based on the temperature of the switching device; and generating the over-temperature signal based on a comparison of the temperature signal and a predetermined temperature.

19. The method of claim 18 wherein generating the temperature signal includes varying a resistance based on the temperature of the switching device.

20. The method of claim 18 wherein the predetermined temperature is represented by a second voltage.

21. The method of claim 18 wherein the switching device is comprises a transistor.

22. The method of claim 18 wherein the solenoid module comprises a spring-loaded pilot duty solenoid.

23. The method of claim 22 further comprising, after interrupting the current to the electric heater, mechanically resetting the solenoid module to restore the current to the electric heater.

24. The method of claim 18 further comprising selectively controlling the solenoid module to interrupt the current to the electric heater based on the control signal.

25. The method of claim 24 further comprising:

making a voltage measurement; and controlling the solenoid module to interrupt the current to the electric heater when the control signal instructs the switching device to turn off the electric heater and the voltage measurement indicates that the electric heater is on.

26. The method of claim 24 further comprising:

making a current measurement; and controlling the solenoid module to interrupt the current to the electric heater when the control signal instructs the switching device to turn off the electric heater and the current measurement indicates that the electric heater is on.

27. The method of claim 24 further comprising controlling the solenoid module to interrupt the current to the electric heater by connecting a voltage source to the solenoid module.

28. The method of claim 18 wherein the solenoid module is provided in series between the switching device and the electric heater.

29. The method of claim 18 further comprising controlling the solenoid module to interrupt the current to the electric heater when (i) the control signal instructs the power to be removed from the electric heater but (ii) a measurement indicates that current is still flowing to the electric heater.

30. The method of claim 18 further comprising:

generating a short circuit signal based on a comparison between a voltage across the electric heater and a reference voltage; and using the switching device, disconnecting the power to the electric heater based on generation of the short circuit signal.

31. The method of claim 30 further comprising:

generating a timer fault signal when a length of time exceeds a predetermined time, wherein the length of time measures how long the control signal has instructed the electric heater to be on continuously; and using the switching device, disconnecting the power to the electric heater based on generation of the timer fault signal.

32. The method of claim 31 further comprising:

generating a disable signal in response to generation of either of the short circuit signal and the timer fault signal; and using the switching device, disconnecting the power to the electric heater based on generation of the disable signal.

33. The method of claim 32 further comprising:

stopping generating the disable signal when the power is removed; and waiting to generate the disable signal again until one of the short circuit signal or the timer fault signal is generated.

* * * * *